US007140954B2

(12) United States Patent
Johnson et al.

(10) Patent No.: US 7,140,954 B2
(45) Date of Patent: Nov. 28, 2006

(54) HIGH PRESSURE CLEANING AND DECONTAMINATION SYSTEM

(75) Inventors: Samuel A. Johnson, Loveland, CO (US); Joseph E. Dixon, Fort Collins, CO (US)

(73) Assignee: S. A Robotics, Loveland, CO (US)

( * ) Notice: Subject to any disclaimer, the term of this patent is extended or adjusted under 35 U.S.C. 154(b) by 177 days.

(21) Appl. No.: 10/970,214

(22) Filed: Oct. 21, 2004

(65) Prior Publication Data

US 2006/0089090 A1 Apr. 27, 2006

(51) Int. Cl.
*B24C 3/00* (2006.01)

(52) U.S. Cl. ..... 451/75; 451/99

(58) Field of Classification Search ..... 451/7, 451/38, 39, 40, 90, 91, 92, 99, 53, 75
See application file for complete search history.

(56) References Cited

U.S. PATENT DOCUMENTS 5,365,699 A * 11/1994 Armstrong et al. ..... 451/7
5,400,602 A * 3/1995 Chang et al. ..... 62/50.7
5,632,150 A * 5/1997 Henzler ..... 62/52.1
5,901,623 A * 5/1999 Hong ..... 82/50
5,916,246 A * 6/1999 Viegas et al. ..... 62/50.1
6,174,225 B1 * 1/2001 Becker ..... 451/75
2006/0053165 A1 * 3/2006 Hume et al. ..... 707/104.1

* cited by examiner

*Primary Examiner*—Jacob K. Ackun, Jr.
(74) *Attorney, Agent, or Firm*—Holland & Hart LLP

(57) ABSTRACT

Abrasive cleaning and decontamination methods and systems are disclosed. The methods and systems use a high pressure liquefied gas, such as carbon dioxide, which produces insignificant quantities of secondary waste. These principles of the invention exploit the properties of the relatively high triple point of $CO_2$ in order to first pressurize it to 35,000 to 60,000 PSI from a pressurized liquid. In the pressurized state, such a fluid can be at or above room temperature, allowing for transport over long distances in a flexible high pressure hose. At a point of use, a heat exchanger may subsequently chill the liquid, so that after expansion through a small high pressure orifice, a significant fraction of the liquid is converted to solid phase crystals exiting at high velocity to effectively clean and decontaminate. For more aggressive cleaning, abrasive particles and/or small diameter solid $CO_2$ pellets can be entrained into the high pressure $CO_2$ slipstream.

11 Claims, 6 Drawing Sheets

HIGH PRESSURE CLEANING AND DECONTAMINATION SYSTEM

FIELD OF THE INVENTION

The present invention is directed to high pressure cleaning and decontamination methods and systems, and, more particularly, to non-cryogenic cleaning and decontamination methods and systems.

BACKGROUND OF THE INVENTION

Many types of surfaces require cleaning and decontamination of coatings and residues without significant impact to the base surface. It is desirable to aggressively clean a variety of coatings and contaminants without leaving behind additional cleaning residues, such as chemical solvents, water, grit media, etc. This is particularly problematic in the field of nuclear radioactive facility clean-out and decontamination, as any cleaning substance will likewise become radiologically contaminated. Disposing of large volumes of cleaning materials becomes costly, dangerous, and time consuming. What is therefore desired is a cleaning media imparting high kinetic momentum transfer to relatively hard particles which impact the surface to be cleaned, but then sublimate into a harmless gas. This is particularly important in the cleaning and decontamination of nuclear radioactive related facilities, where even tiny amounts of residual nuclear contamination deposited on surfaces or diffused therein are highly hazardous and expensive to remove and dispose of with conventional methods. As an example, disposal of a single gallon of nuclear radioactive contaminated water used as a cleaning agent can cost in excess of $1000. To dispose of contaminated solid material can cost $50–500 per pound, depending on the contamination level. It is therefore desirable to clean every nook and cranny on equipment and facilities, so that the dismantled structures can be classified as low level waste, which can be cheaply handled and buried at approved nuclear burial sites.

A known method for cleaning involves the use of $CO_2$ pellets accelerated by a source of compressed air. Patents describing the use of $CO_2$ pellets for cleaning include U.S. Pat. No. 5,109,636 to Lloyd, et al. and U.S. Pat. No. 5,445,553 to Cryer, et. al. Other cleaning systems generate a source of $CO_2$ snow, which are, in effect, small diameter solid particles. Cleaning systems generating $CO_2$ snow are described, for example, in U.S. Pat. No. 5,514,024 and U.S. Pat. No. 5,390,450 to Goenka. Nevertheless, the systems described in the referenced patents do not possess sufficient energy to ablate and clean the types of surfaces commonly found in a contaminated nuclear facility. In a nuclear facility, it is desirable to clean painted metals down to the base material, or abrade concrete with up to 2–4 mm surface material removal, because radiological contaminates can directly and indirectly diffuse into porous structures.

Other existing methods of cleaning involve the use of high pressure cryogenic liquids that are sprayed from a high pressure nozzle. U.S. Pat. No. 5,733,174 to Bingham et al., is typical of the use of high pressure cryogenic liquid use. Bingham et al. discloses a slurry of high pressure Nitrogen and $CO_2$ co-existing as a slurry, which is pumped at high pressure and delivered to a surface to be cleaned as a jet. The $N_2$ and $CO_2$ are in a liquid state, the $N_2$ comprising a cryogenic fluid and the $CO_2$ comprising a non-cryogenic fluid. As the $N_2$ and $CO_2$ expand through a high pressure orifice, a phase change occurs. The $CO_2$ is super-chilled and precipitates to solid $CO_2$ particles at high velocity. The solid $CO_2$ particles eventually evaporate, leaving no secondary waste. The disadvantages of such typical cryogenic systems include the required use of rigid, non-flexible high pressure metallic tubing for delivery of the cryogen to the nozzle orifice. Rigid tubing poses severe limitations on the ability to maneuver an orifice cleaning head to desired orientations needed to access complex equipment needing cleaning and decontamination, particularly when such equipment is in highly hazardous closed cells and only robotic access is possible. In addition, rigid cryogenic tubing requires highly effective insulation, since the cryogenic liquid within the tubing is at a very low temperature, and must be maintained at low temperatures until it exits the orifice. Moreover, cryogenic $N_2$ is a very expensive to purchase, deliver, and pump.

Accordingly, there is a need for an improved non-cryogenic cleaning system that can be deployed in remote and inaccessible environments using an ambient temperature low cost flexible hose, and which is much more aggressive in terms of effective material removal.

SUMMARY OF THE INVENTION

As described herein, the present invention overcomes the problems and disadvantages of prior cryogenic and particle blast cleaning systems and methods. Stated generally, the principles of the present invention exploit the properties of the relatively high triple point of $CO_2$ in order to first pressurize it to 35,000 to 60,000 psi from a non-cryogenic liquid. In the pressurized state, such a fluid can be at or above room temperature, allowing for transport over long distances in a flexible, high pressure hose. At a point of use, a heat exchanger subsequently chills the liquid, so that after expansion through a small high pressure orifice, a significant fraction of the liquid is converted to solid phase crystals exiting at high velocity to effectively clean and decontaminate. For more aggressive cleaning, either abrasive particles or small diameter solid $CO_2$ pellets can be entrained into the high velocity $CO_2$ slipstream.

The present invention also provides a source of bulk non-cryogenic $CO_2$ liquid delivered in a pressurized, insulated tank or the like. A heat exchanger removes a predetermined amount of heat from the liquid prior to entering an intensifier. Preferably, the pressure and temperature at an entrance to the intensifier ensures the liquid is totally saturated. With a typical inlet liquid pressure of 300 PSI, the liquid temperature should be maintained below 0 degrees Fahrenheit. A piston-type liquid-to-liquid intensifier pumps the $CO_2$ liquid by means of a conventional hydraulic power supply. The intensifier may have a liquid cooled jacket surrounding the internal piston elements to remove heat and ensure a saturated liquid condition internal to the intensifier. The piston-type hydraulically driven liquid-to-liquid intensifier has the ability to intensify the outlet pressure to in excess of 50,000 PSI, at flow rates between 1–3 gallons per minute.

The temperature of the high pressure outlet fluid may be maintained above a specific minimum, in order to allow the use of a flexible hose such as a thermoplastic braided hose. Thermoplastic braided hoses tend to become brittle and rigid at extreme cold temperatures, such as those encountered with most high pressure cryogenic liquids. However, the ability to use a commercially available flexible hose may be important in order to allow easy access and routing of the hose into a working environment, and more importantly, to a high pressure orifice nozzle which creates the necessary high velocity fluid jet. Such an orifice nozzle may be of small diameter, between approximately 0.01 inches and 0.03 inches in diameter, and may be constructed of a very hard material, such as ruby or diamond, in order to resist the effects of wear.

It is desirable to place a heat exchanger upstream or just before the high pressure orifice, in order to remove a predetermined amount of heat from the high pressure liquid, rendering the liquid to a substantially lower temperature just before entry into the high pressure orifice. It may be desirable to cool the liquid $CO_2$ to below about 0 degrees Fahrenheit or colder at the orifice. In such a state, when the cooled $CO_2$ liquid exits the high pressure orifice, a phase transition occurs as the high pressure liquid enters a region of lower pressure across a formed shock wave. At such an instant, a significant fraction of the liquid converts to solid $CO_2$ crystals, thus forming $CO_2$ "snow." A remaining fraction of the $CO_2$ converts to a gaseous phase by sublimation. The snow retains its momentum, along with the gas, at velocities that may be in excess of the speed of sound. Thus, the $CO_2$ snow becomes a projectile capable of significant cleaning action when it impacts a surface to be cleaned. Likewise, a significant drop in temperature of both the snow and the gas occur due to isentropic expansion, creating enhanced cleaning action as a result of thermal shock.

Another aspect of the invention facilitates even more aggressive cleaning by injection of very hard abrasive particulates downstream or just after the high pressure orifice. Such an abrasive material may include, but is not limited to: garnet crystals accelerated by the non-cryogenic fluid stream to very high supersonic velocities.

Another aspect of the invention provides for the injection of $CO_2$ pellets into the high velocity non-cryogenic liquid stream downstream or just after the high pressure orifice in order to further clean. The pellets may be significantly larger than the $CO_2$ snow particles. The injection of $CO_2$ pellets may provide superior cleaning removal rates than previous methods, including the previous methods using compressed air disclosed in U.S. Pat. Nos. 5,109,636; 5,445,553; 5,514,024 and 5,390,450.

Another aspect of the invention provides for the simultaneous application of two or more of the above-identified practices, i.e. mixing abrasive particulates, $CO_2$ pellets, and/or the high velocity liquid non-cryogenic jet into a combined cleaning stream. Such a combination method or system may be particularly advantageous because the abrasive particulate media tends to embed in the surface of the large mass $CO_2$ pellets, effectively increasing the momentum transfer to the surface to be cleaned many fold. The high velocity liquid non-cryogenic jet may comprise a cutting tool according to some aspects of the invention.

Another aspect of the invention involves the mechanical agitation of a chemically treated surface used to extract contamination embedded into porous and nonporous substrates. The agitation may include a cleaning process and water-based cleaning compositions effective for the removal of radionuclides, polychlorinated biphenyls, pesticides, herbicides, and heavy metals from surfaces of all types, especially porous surfaces, surfaces that contain irregularities and microscopic voids into which contaminants may migrate and lodge, thereby creating a substrate below the surface that must also be cleaned, and particulate surfaces. The cleaning blends and processes remove contaminants from porous and irregular surfaces to a certain depth below the surface and into the substrate. However, it may be necessary to mechanically agitate, rub with cloth rags, and/or rinse a treated surface to remove the extracted contaminants. This may involve the presence of human workers, who must be suitably protected to perform such tasks. It is an advantage of the present invention that when combined with such chemical decontamination methods, that non-contact, fully remote and automatic cleaning of such surfaces can be effected, without exposing workers to such direct hazards, with zero secondary waste stream creation.

Additional advantages and novel features of the invention will be set forth in the description which follows or may be learned by those skilled in the art through reading these materials or practicing the invention. The advantages of the invention may be achieved through the means recited in the attached claims.

BRIEF DESCRIPTION OF THE DRAWINGS

The accompanying drawings illustrate preferred embodiments of the present invention and are a part of the specification. Together with the following description, the drawings demonstrate and explain the principles of the present invention.

Throughout the drawings, identical element numbers designate similar, but necessarily identical, elements.

DETAILED DESCRIPTION OF THE PREFERRED EMBODIMENTS

Figure 1:
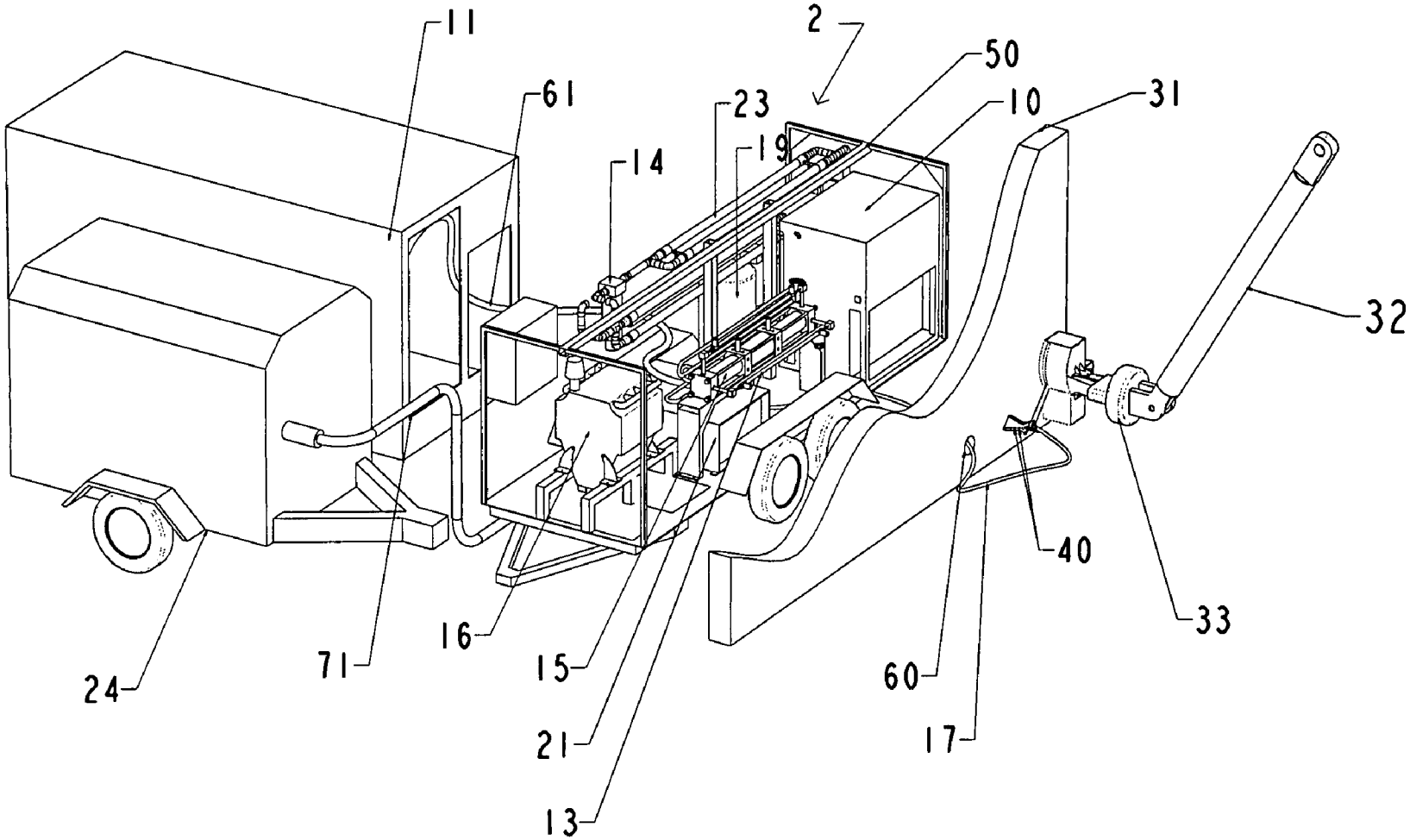
FIG. 1 is an isometric view of a $CO_2$ cleaning system applied to a robot manipulator system within a contaminated nuclear cell according to one aspect of the present invention.

Referring now to the drawings, FIG. 1 illustrates a non-cryogenic cleaning system 2 constructed in accordance with principals of the present invention. The term "non-cryogenic" as used throughout the specification, including the claims, refers to a class of fluids that are gasses under atmospheric conditions, but may be pressurized to liquid states at temperatures that are at least high enough to allow elastomeric hoses to remain flexible. Non-cryogenic fluids thus include, but are not limited to: carbon dioxide, sulfur dioxide, and ammonia. However, non-cryogenic fluids according to principles of the present invention are preferably inert or benign. The non-cryogenic cleaning system 2 is shown in relation to a contaminated cell 31. The contaminated cell 31 may be sealed and house articles or equipment in need of cleaning and/or decontamination. The contaminated cell 31 may comprise any area, room, enclosure, or interior of a larger piece of equipment. For purposes of discussion, the cell 31 is a sealed room contaminated with radioactive nuclear material. A remotely operated, motorized robot arm 32 is one of many deployment methods available to move a cleaning nozzle 40 along a desired trajectory at a pre-determined distance in order to affect effective cleaning or decontamination of surfaces within the contaminated cell 31. The majority of systems needed to power and prepare the liquid and media needed by the cleaning nozzle 40 are preferably located outside of the contaminated cell 31, so as to be easily accessed and maintained by operators, technicians, and support personnel.

Figure 3:
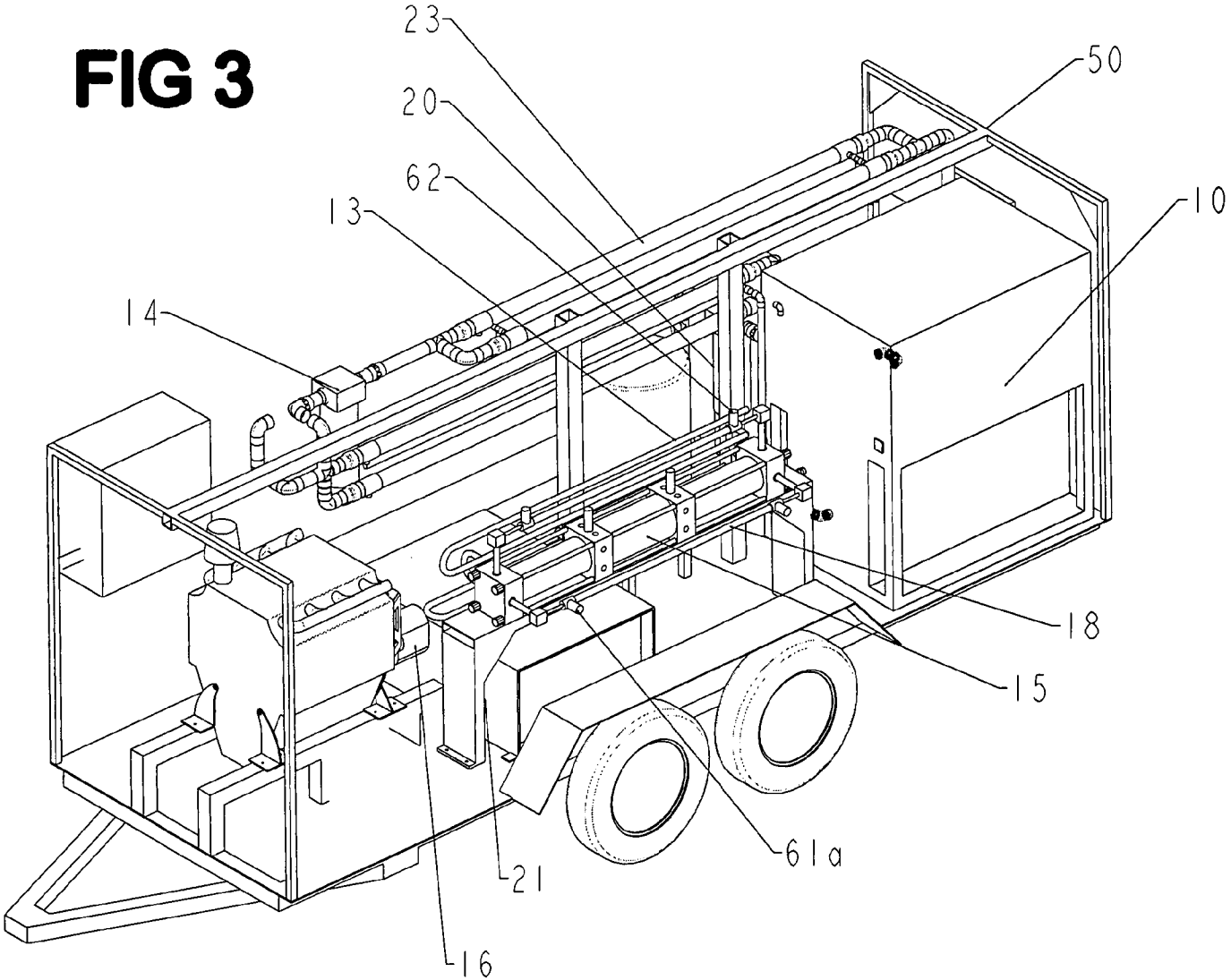
FIG. 3 is a detailed isometric view of the $CO_2$ cleaning system shown in FIG. 1.

A compressor such as air compressor 24 shown outside the contaminated cell 31 is a commercially available trailer or skid mounted air compressor, capable of supplying at least approximately 120 PSI air at 200–1000 CFM. However, other compressors may also be used. A tank 11 is coupled to the air compressor 24, and may be a commercially available $CO_2$ non-cryogenic bulk tank, capable of containing contents at elevated pressures between approximately 50 and 300 PSI. The tank 11 can easily be refilled with non-cryogenic liquid $CO_2$ by a tanker truck, a rail-car, or other $CO_2$ supply. A trailer 50 is shown adjacent to the contaminated cell 31 and houses many non-cryogenic cleaning components according to the embodiment shown. According to the embodiment of FIG. 1, the trailer 50 houses a pumping system such as a diesel powered hydraulic pumping system 16, and may include one or more of: a first heat exchanger 13, a filter 14, an intensifier 15, a refrigeration unit 10, a hydraulic fluid reservoir 21, a second heat exchanger 23, a $CO_2$ pellet hopper 19, an abrasive particle hopper 20 (FIG. 3), and a variety of other controls and equipment. A feed line 61 which may comprise a non-cryogenic hose, connects the non-cryogenic $CO_2$ tank 11 to a trailer mounted $CO_2$ intake port 62 (FIG. 3). Likewise, an air hose 71 connects the air compressor 24 to the second heat exchanger 23, which may be a trailer mounted air heat exchanger.

Alternatively, the tank 11 may be a commercially available cryogenic bulk tank, capable of containing cryogenic fluids. The tank 11 can easily be refilled with cryogenic liquids by a tanker truck, a rail-car, or other cryogenic fluid supply.

An umbilical cable tether line 17 contains one or more hoses and insulated fluid lines, which can easily enter a contaminated area through a single sealed penetration port 60. The components described above are shown in a preferred embodiment that can be easily transported from job site to job site, along with any contaminated material which may or may not be recovered from the contaminated cell 31. It will be appreciated, however, that permanent installation is contemplated by the invention as well, and the cleaning components are not necessarily portable as shown in FIG. 1.

Figure 2:
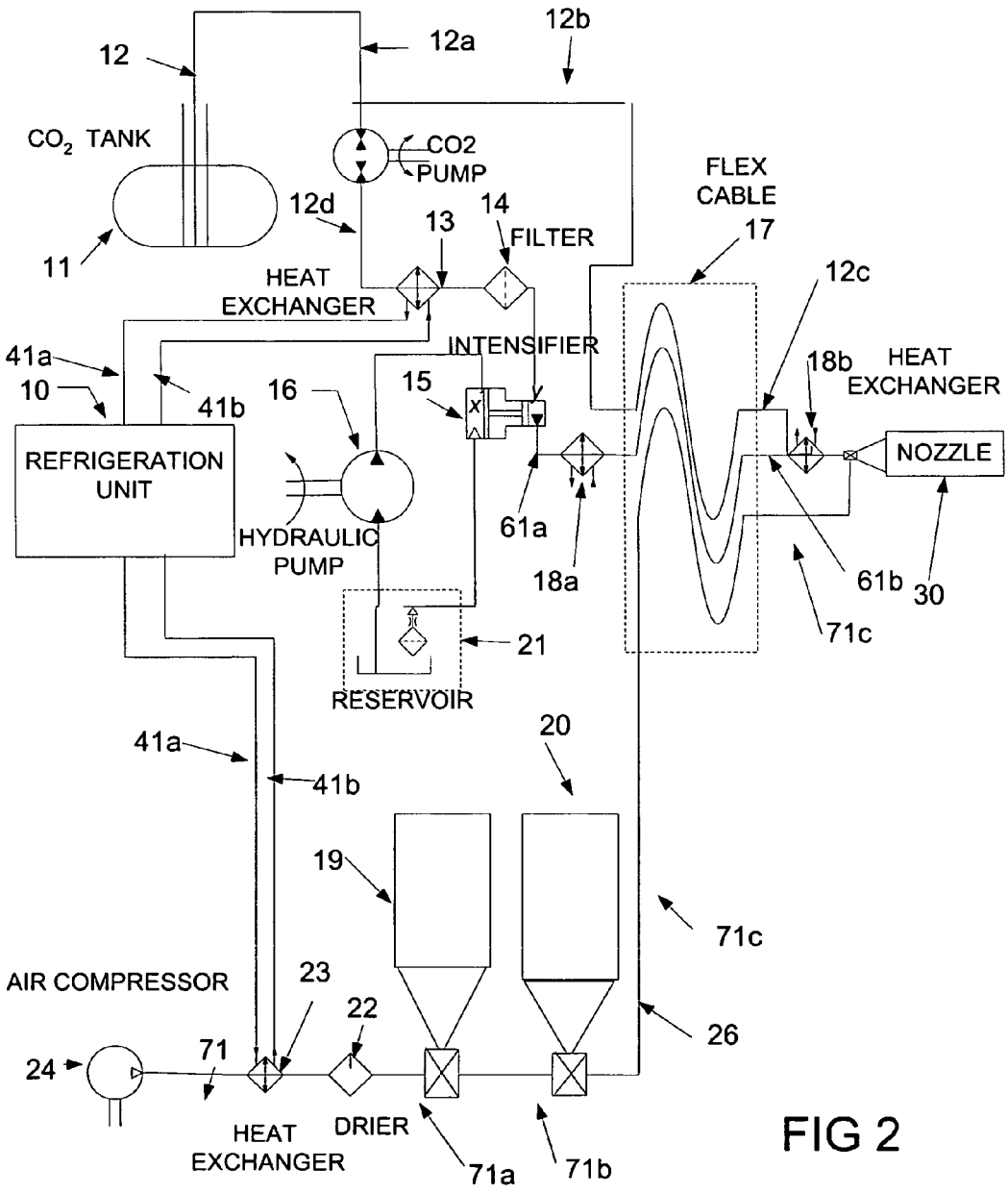
FIG. 2 is a schematic drawing of a $CO_2$ cleaning system according to one embodiment of the present invention.

Referring next to FIG. 2, a schematic representation of the interconnectivity of components of the cleaning system 2 is shown according to one embodiment of the present invention. The $CO_2$ bulk tank 11 may be of any capacity, but for large cleaning projects, preferably holds approximately 4–30 tons (8,000 to 60,000 pounds) of liquefied $CO_2$. $CO_2$ in liquid form is readily available by industrial gas suppliers worldwide, and is by far the least expensive liquefied gas available due to its wide application in the food and beverage industries, industrial processes, and the like. By way of example, the present cost per pound of liquefied $CO_2$ is \$0.08 to \$0.12 per pound. Liquid nitrogen, a popular cryogenic liquid for high pressure cryogenic cleaning applications, costs in excess of \$1.00 per pound. $CO_2$ has advantageous cleaning properties compared with cryogenic liquids, including higher specific density, and, importantly, a critical point of 87.8 degrees Fahrenheit at a pressure of 1066.3 PSIA. Thus, $CO_2$ can exist as a liquid at substantially higher temperatures than can cryogenic $N_2$, which has a critical point of minus 264 degrees Fahrenheit, at a pressure of 492.3 PSIA.

Accordingly, although it is necessary to cryogenically insulate high pressure liquid nitrogen lines in order to prevent vapor formation within a hose, liquid $CO_2$ may exist at room temperatures within a pressurized hose, advantageously avoiding the need to insulate fluid-bearing hoses. Therefore flexible hoses manufactured, for example, from polymeric materials such as nylon, Delrin®, Teflon®, etc., and wrapped in multiple layers of high tensile steel braid may be used according to principles of the present invention to carry liquid $CO_2$.

However, flexible hoses can not typically operate at temperatures below about 0 degrees Fahrenheit due to lack of flexibility, and eventual hardening and cracking. And as discussed above, suitable rigid hoses capable of delivering high pressure liquid nitrogen have great limitations related to deployment, as rigid hoses can not be bent to tight radii, twisted, or manipulated.

Attached to the tank 11 is a booster pump 9, which is capable of increasing the pressure of the liquid contents of the tank 11 from 50–300 PSI to approximately 500–1000 PSI. It may be important to have a relatively low pressure non-cryogenic liquid in a fully saturated state prior to being pumped to extreme pressure by the intensifier 15. Therefore, to ensure a fully saturated liquid, the first heat exchanger 13 may be a liquid-to-liquid heat exchanger and may lower the $CO_2$ liquid in a first portion 12*a* of a feed line 12 well below ambient conditions, for example about 20 to 30 degrees Fahrenheit. Ambient temperature can often be above 90–100 degrees Fahrenheit, and heat loss through the first portion 12*a* of the feed line 12 may create an unwanted partial vapor state. The filter 14 removes particulates and residues, as the fluid intensifier 15 may include many close-tolerance moving parts that can be damaged by particulates.

The fluid intensifier 15 may operate according to the well known principle of differential hydrostatic areas. Therefore, the fluid intensifier 15 may have pistons of substantially different surface areas connected by a single rod element, thus forming two distinct pressure chambers separated by a seal above the connecting rod element. The achievable outlet pressure using the intensifier 15 described above is proportional to the ratio of the piston areas, multiplied by the operating fluid pressure. Thus, a differential area intensifier having an input/output piston ratio of 20:1, which uses 3,000 PSI hydraulic fluid as the driving fluid, is capable of generating about 60,000 PSI in a high pressure $CO_2$ line 61*a* which is in fluid communication with an outlet of the intensifier 15. Differential area intensifiers such as intensifier 15 are well known in the industry to those of skill in the art having the benefit of this disclosure.

Because $CO_2$ can be intensified at relatively high temperatures, only minor (or no) modifications to conventional oil or water intensifiers may be necessary for successful intensification of liquid $CO_2$. The modifications may include providing a water cooled jacket around the intensifier 15, which removes much of the heat generated by compression and friction effects. Still, the high pressure outlet temperature in the high pressure fluid line 61*a* downstream of the intensifier 15 may sometimes exceed 120 degrees Fahrenheit and therefore require further heat exchange.

Accordingly, some embodiments of the present invention may include a third heat exchanger 18*a*. The third heat exchanger 18*a* may be cooled to, for example, 20–30 degrees Fahrenheit, or to cryogenic temperatures by use of a suitable cooled gas or by the adiabatic expansion of a gas jet. A pair of cooling lines 41*a* and 41*b* shown connected to the first and second heat exchangers 13, 23 are omitted for schematic simplicity with regard to the third heat exchanger 18*a* in FIG. 2. Nevertheless, the cooling lines 41*a*, 41*b* are connected to the third heat exchanger 18*a*. The heat exchangers 13, 18*a*, 23 may be cooled in a variety of well known ways, including, but not limited to: refrigerated water, refrigerated hydrocarbons, or even cryogenic or non-cryogenic gasses. In one preferred embodiment shown in FIGS. 1–2, the refrigeration unit 10 comprises a refrigerated water chiller of commercial design which circulates an ethylene glycol/water mix at about 20 degrees Fahrenheit. For the preferred embodiment, the capacity of the refrigeration unit 10 may be approximately 60,000 BTU per hour, or the thermodynamic equivalent of a 5 ton HVAC water/glycol circulated chiller. The refrigeration unit 10 may provide a common source of refrigerated coolant for several heat exchangers, including those identified by elements 13, 18*a*, 18*b*, and 23. The fourth heat exchanger 18*b* is discussed below.

The air compressor 24 may be a commercial skid or trailer mounted unit, and may be transported to virtually any industrial site. According to the embodiment shown in FIGS. 1–2, the air compressor 24 may provide 100–300 CFM at 125 PSI. However, other air compressors of different performance may also be used. The air hose 71 connects a compressor outlet to a liquid or air heat exchanger such as the second heat exchanger 23 shown in FIG. 2. The second heat exchanger 23 may lower the compressed air temperature, for example from about 120 degrees Fahrenheit to 30–40 degrees Fahrenheit. A drier 22 may be used to remove the condensate water, in order to provide a dry air supply. A $CO_2$ pellet hopper 19 may be provided for dispensing pre-determined quantities of pre-manufactured $CO_2$ pellets into the air hose 71 at a first injection portion 71*a* of the air hose 71. The rate of $CO_2$ pellet injection may be set and varied as desired by an operator to affect effective cleaning. The $CO_2$ pellet hopper 19 and associated feed delivery systems are commercially available from Cold-Jet, Inc., of Loveland, Ohio, or other manufacturers in the field. In the preferred embodiment shown in FIG. 2, the $CO_2$ pellets provided to the $CO_2$ pellet hopper 19 comprise a relatively oblong diameter of about 0.125 inches by about 0.090 inches, although any $CO_2$ pellet shape may also be used.

A second injection portion 71*b* of the air hose 71 connects the outlet of the $CO_2$ hopper 19 to an inlet of an abrasive particle hopper 20. The abrasive particle hopper 20 is commonly used for sandblasting, and has the ability to deliver a pre-determined amount of small diameter abrasive media into an outlet portion 71*c* of the air hose 71. The abrasive particles are preferably made of garnet or other hard, abrasive material.

A combination of $CO_2$ pellet injection and abrasive particle injection may be particularly advantageous in creating abrasively coated dry ice particles as the combination of $CO_2$ pellets and abrasive particles mix in the outlet portion 71*c* of the air hose 71. Since the abrasive particles are typically at a temperature far in excess of the frozen $CO_2$ particles injected upstream, they tend to melt into and embed in the surface of the much larger mass $CO_2$ particles. The embedding of the abrasive particles into the $CO_2$ particles dramatically increases the effective momentum of the plurality of abrasive particles, which coat the exterior surface of the $CO_2$ particles. As discussed in more detail below, having high surface hardness abrasive particles impacting a surface to be cleaned with high momentum is particularly effective at cleaning and abrading an impacted surface, while contributing a minimal amount of residual secondary contamination as compared to conventional sandblasting methods. It will be understood that according to some embodiments, only one of the $CO_2$ pellet hopper 19 and the abrasive particle hopper 20 may be used.

The umbilical cable tether line 17 shown in FIG. 1 may comprise a flexible cable bundle and may collect the air and fluid lines including the high pressure fluid line 61*a*, the outlet portion 71*c* of the compressed air hose 71, and the heat exchanger coolant hoses 41*a* and 41*b*, if needed. Also, a low pressure liquid $CO_2$ coolant portion 12*b* of the feed line 12 can also be included if needed. Such a flexible cable bundle can be easily and simply routed into a contaminated facility through the wall penetration port 60, as shown on FIG. 1, or through existing doors, stairwells, ventilation ducts, etc. Since the flexible umbilical cable tether line 17 is compliant to flex or bend or coil, it is very easy to route where desired with the robot arm 32. Alternatively, the umbilical tether line 17 may be rigid or otherwise suitable for use with cryogenic fluids.

The cleaning nozzle 40 is shown in FIG. 2 receiving both high pressure $CO_2$ liquid from the high pressure fluid line 61*b*, and optionally compressed air from the outlet portion 71*c* of the air hose 71 having $CO_2$ pellets or abrasive garnet particles, or a combination thereof. The fourth heat exchanger 18*b* may be included to sub-cool $CO_2$ liquid within the high pressure fluid line 61*b* to a very cold state if desired. In the present embodiment, either glycol chilled water at approximately 20–30 degrees Fahrenheit, or low pressure $CO_2$ liquid may be routed to its coils. The advantage of a low pressure $CO_2$ cooling system, as shown via the low pressure liquid $CO_2$ coolant portion 12*b* of the feed line 12, is that upon expansion of the liquid from the heat exchanger 18*b* to ambient pressure, adiabatic expansion thereby cools the heat exchanger 18*b* to minus 140 degrees Fahrenheit, thereby cooling the high pressure $CO_2$ fluid line 61*b* to very cold temperatures. The cooling of the high pressure fluid line 61*b* ensures a high percentage of $CO_2$ snow generation when the ultra high pressure $CO_2$ exits the cleaning nozzle 40, as later described. Thus, the $CO_2$ liquid can be chilled to temperatures far below what a flexible hose might withstand at or near the cleaning nozzle 40 by low pressure cryogenic or non-cryogenic gas expansion through an expansion valve, accumulation of $CO_2$ pellets into the surface of the fourth heat exchanger 18*b*, delivery of a chilled glycol fluid via fluid lines 41*a* and 41*b*, or other mechanisms.

Figure 6:
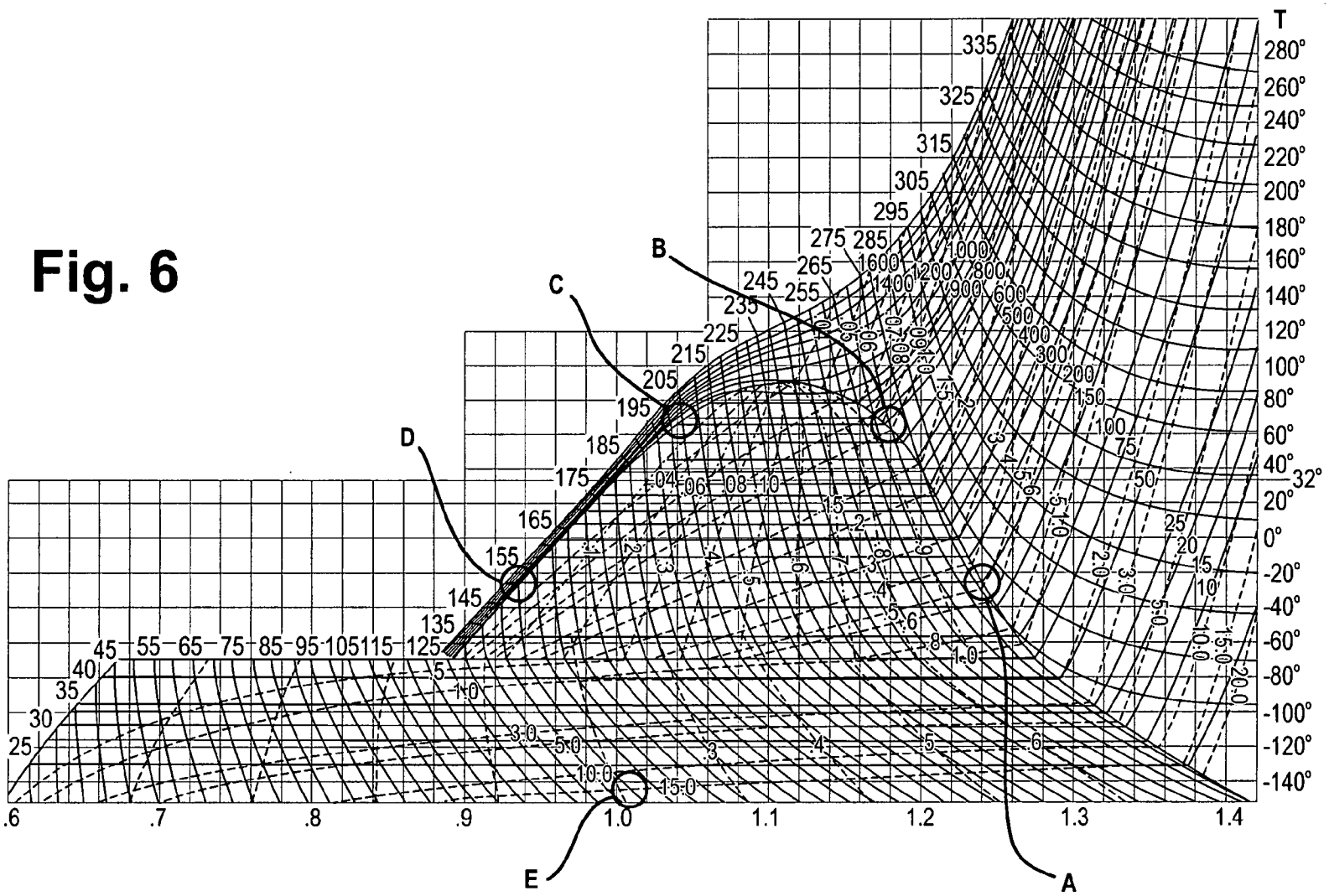
FIG. 6 is a diagram showing the thermodynamic phases of $CO_2$ in solid, liquid, and gaseous phases.

Referring now to FIG. 6, phase properties of carbon dioxide are presented as a temperature-entropy plot. According to the plot of FIG. 6, various fractions of phase mixtures are presented, unlike typical temperature-pressure plots. According to the phase plot of FIG. 6, element A illustrates a typical state of the saturated liquid as delivered from the tank 11 (FIG. 2). Generally, this state is defined at negative 20 degrees Fahrenheit and at a pressure of 150 PSI. The booster pump 9 of FIG. 2 increases the pressure to about 800 PSI, shown as phase state B in FIG. 6, which allows the liquid to be delivered via a non insulated hose 12*d* (FIG. 2) to the first heat exchanger 13 (FIG. 2). The primary purpose of the first heat exchanger 13 (FIG. 2) is to cool the liquid prior to entry into the intensifier 15 (FIG. 2) to ensure a completely saturated liquid state. The intensifier 15 (FIG. 2) increases the liquid pressure to 35,000–60,000 PSI or more, to a state represented by C of FIG. 6. The ultra high pressure ensures that the liquid will always remain saturated, and can be piped great distances without the need for insulated or refrigerated hoses. Element D of FIG. 6 identifies the state of the $CO_2$ following the removal of heat from the fluid after passing through the fourth heat exchanger 18*b* (FIG. 2). In a preferred embodiment, the fourth heat exchanger 18*b* is located at or near the intended point of use, shown in FIG. 2 just upstream of the cleaning nozzle 40, and can be cooled by a variety of means, including, but not limited to: chilled glycol-based water solution, commercial refrigerants, dry-ice solid particles, or even the expansion of high pressure $CO_2$ liquid impinging and evaporating on coils of the fourth heat exchanger 18*b*.

Figures 4A, 4B:
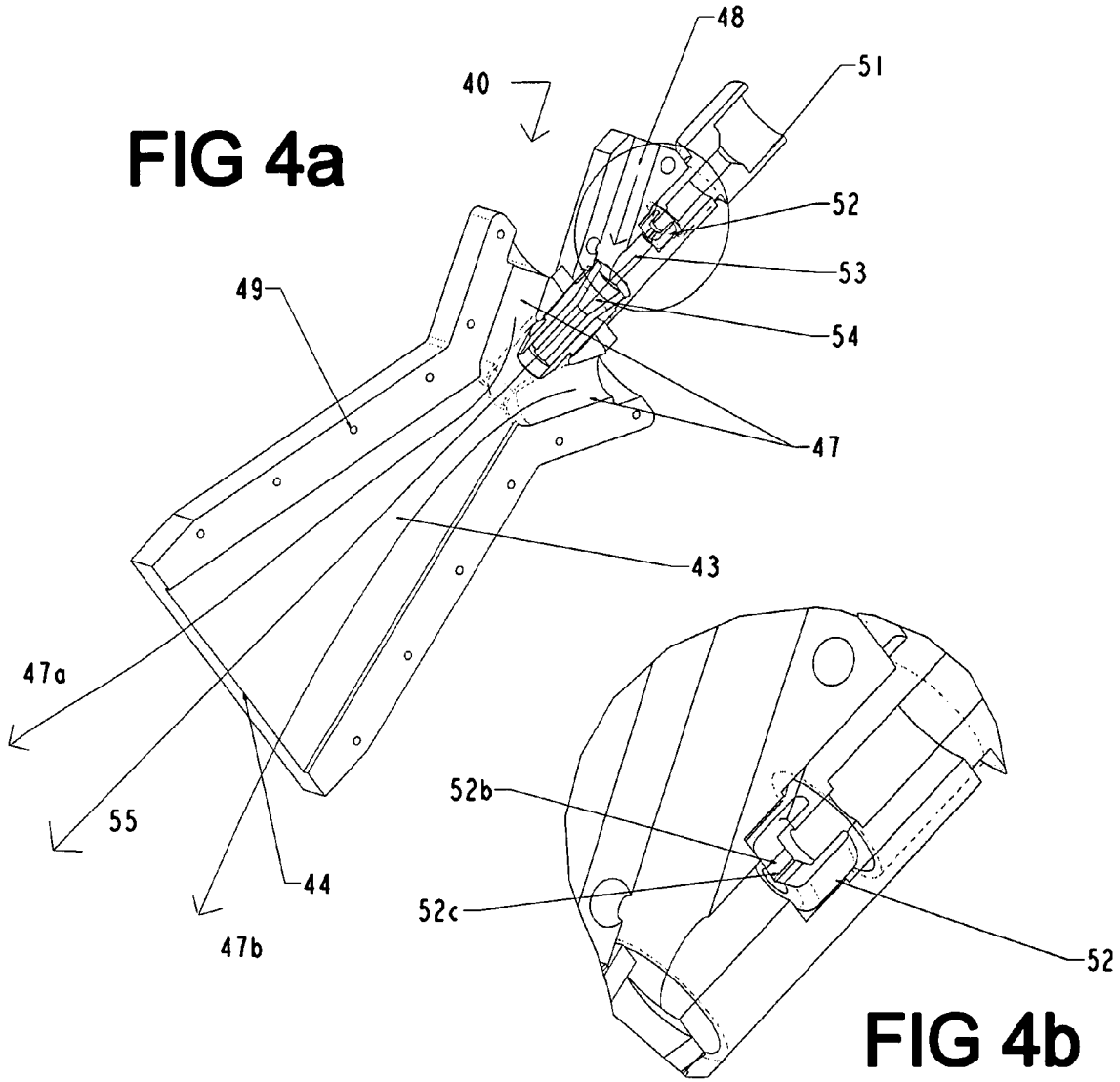
FIG. 4*a* is a partial cross sectional view of a high pressure liquid $CO_2$ orifice, nozzle, and supersonic mixing chamber according to one embodiment of the present invention.
FIG. 4*b* is a blown up portion of the cross sectional view shown in FIG. 4*a*.

Finally, after the $CO_2$ liquid is chilled by the fourth heat exchanger 18*b*, it exits a nozzle orifice 52*c* of the cleaning nozzle 40 (FIGS. 2, 4*a*), shown in detail in FIG. 4*b*. The nozzle orifice 52*c* may be fabricated from a very hard material, such as ruby or diamond, and is represented as element 52*b* or replaceable orifice element 52. As the $CO_2$ liquid exits the nozzle orifice 52*c*, the state of the $CO_2$ liquid follows a constant enthalpy line from point D to E of FIG. 6. Therefore, upon exit of the $CO_2$ liquid to atmospheric pressure, at least 50% of the $CO_2$ changes from liquid to small, solid particles.

The small, solid $CO_2$ particles, referred to as $CO_2$ snow, enhance cleaning effectiveness, as solid particles are harder than the liquid or gaseous components also formed. Additionally, since all $CO_2$ fractions formed exit the nozzle orifice 52*c* at high velocity, each becomes a propellant mechanism for introducing other high momentum and high hardness particles, such as $CO_2$ pellets, abrasive garnet crystals, and the like.

Referring to FIGS. 4*a*–4*b*, details of the cleaning nozzle 40 according to one embodiment of the present invention are shown. The flexible high pressure $CO_2$ feed hose 61*b* (FIG. 2) terminates at a high pressure manifold block 52 by a coupler 51. Not shown for clarity in FIGS. 4*a*–4*b* is the fourth heat exchanger 18*b* of FIG. 2, referenced earlier. Ultra-high pressure $CO_2$ liquid then passes through the small diameter nozzle orifice 52*c*, to create a very high velocity liquid stream 55. The manifold block 52 may contain one or many small diameter orifices to allow for the creation of high velocity liquid $CO_2$ upon exit. In the preferred embodiment, between one and six such orifices are formed, each orifice (e.g. nozzle orifice 52*c*) is formed of a single crystal, which may preferably comprise ruby or diamond. Hard materials such as ruby and diamond are desirable to minimize wear. The diameters of the one or more orifices such as nozzle orifice 52*c* may be experimentally and routinely determined for best results, but are generally on the order of between 0.01 inches to 0.04 inches in diameter, and may be laser drilled to size.

Fluid velocities upon exit from the nozzle orifice 52*c* can be up to five times the speed of sound, or approximately 6,000 feet per second. In order to prevent standing shock waves inside the cleaning nozzle 40, a carefully calculated and predetermined cross sectional area change may be necessary to allow for supersonic flow at an exhaust slot 44 of the cleaning nozzle 40. Such a cross-sectional profile may comprise the well known d'Lavalle design, and is commonly used in the design of rocket engine nozzles and air blow-off nozzles, etc. For ease of manufacture, a rectangular cross section is preferred, thus forming the exhaust slot 44 with approximate dimensions 0.125 inches by 4 inches. The cleaning nozzle 40 may also contain compressed air inlets 47, which connect via a "Y" manifold to the outlet portion 71*c* of the air hose 71 (FIG. 2). Garnet or other abrasive crystals may also be carried within the outlet portion 71*c* (FIG. 2) from the abrasive particle hopper 20 (FIGS. 2–3), and/or frozen $CO_2$ pellets dispensed by $CO_2$ pellet hopper 19. Compressed air inlets 47 terminate at a nozzle throat narrow section 45.

Because liquid $CO_2$ streamlines 55 likewise flow past and within the narrow throat narrow section 45, a low pressure region is formed for the favorable injection of frozen $CO_2$ pellets and/or abrasive garnet crystals carried in the outlet portion 71*c* of the air hose 71 (FIG. 2). These particles, upon coming into contact or proximity of the liquid $CO_2$ streamlines 55, become accelerated to supersonic velocities, and may roughly follow trajectories presented as streamlines 47*a* and 47*b*. In addition, the compressed air delivered through compressed air inlets 47 become the compressible gas which likewise expands into the d'Lavalle design nozzle and likewise becomes accelerated to nearly match the speed of the liquid $CO_2$ streamlines 55. Thus, unlike conventional air propelled nozzle designs of the prior art which can only accelerate the particles by the expansion of compressed air, the present invention will further accelerate and non-cryogenically cool such particles for increased cleaning effectiveness. This is particularly true for the $CO_2$ pellets which are embedded with high hardness abrasive particles such as garnet crystals.

The mass of the $CO_2$ pellets is on the order of $10^4$ larger than an individual garnet crystal. Therefore, the momentum energy delivered to the surface to be abraded and cleaned is likewise magnified by a factor of $10^4$. Additionally, the sublimation of the liquid $CO_2$ stream and the rapid expansion of the compressed air may cool the cleaning nozzle 40 to sub-zero temperatures. The third heat exchanger 18*a* cools the ultra-high pressure $CO_2$ liquid, which results in conversion of a significant fraction of the liquid $CO_2$ stream to a solid crystalline snow phase. This crystalline snow is also somewhat hard, and very cold, and will contribute to further effective cleaning upon impact. The cleaning nozzle 40 cross section, as shown in the preferred embodiment of FIGS. 4*a*–4*b*, achieves outlet velocities of approximately Mach 2.5 to Mach 3.5. All particles present in the cleaning nozzle 40 are likewise accelerated to similar velocities.

Continuing to reference the embodiment of FIG. 4*a*, there is a tapered focusing element 54, positioned immediately after the replaceable orifice element 52. The side closest to the replaceable orifice element 52 has a tapered, expanded opening, so as to receive the precisely aligned jet of the high pressure liquid stream 55, and also to receive abrasive garnet particles which are delivered via a port 48. Such abrasive particles are relatively small in size, so as to easily pass through the tapered focusing element 54, thus forming a collimated beam of small diameter, high velocity particles. The collimated or combined stream, when entering an expansion nozzle 49, expands to supersonic velocity by the well known d'Lavalle principle. Unlike conventional compressed air operated nozzles of the prior art, this invention may provide for injection of a liquid stream already at supersonic velocities. Furthermore, the nearly immediate sublimation from liquid to gas expands the volume nearly 800 times, further increasing the acceleration of the entrained particles to further enhance cleaning or cutting.

The same nozzle design 40 is capable of abrasive cutting by the simple removal of the expansion nozzle 49. It has been found that cooling the ambient high pressure liquid with the heat exchanger 18*b* of FIG. 2 allows the stream of high pressure $CO_2$ to remain in its liquid state as a focused stream much longer than a non-cooled stream. Having this stream extend at least one inch away from the replaceable orifice element 52, with abrasive particles delivered into it by via the port 48 creates a narrow abrasive-laden liquid stream capable of cutting a variety of materials, including steel, concrete, and other hard to cut objects.

Figure 5:
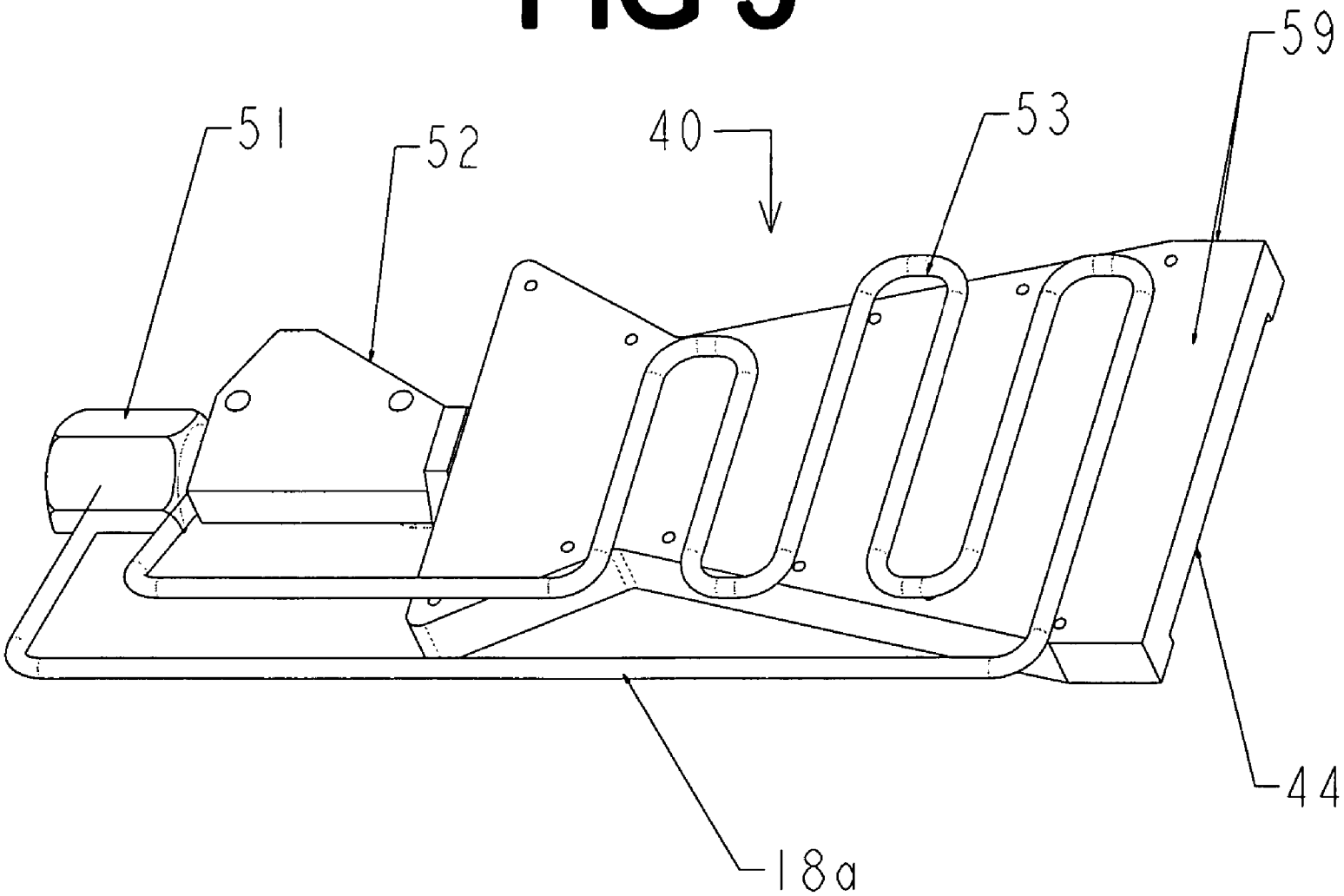
FIG. 5 is a cross sectional view of the nozzle design with an integrated heat exchanger.

FIG. 5 illustrates an improvement for integrating the fourth heat exchanger 18*b* into the cleaning nozzle 40 according to some aspects of the invention. According to the embodiment of FIG. 5, high pressure $CO_2$ liquid from the manifold block 52 is routed into a rigid serpentine pipe 53, which comprises the fourth heat exchanger 18*b* shown in FIG. 2. The rigid serpentine pipe 53 is formed to be in intimate thermal contact with an exterior flat surface 59 of the cleaning nozzle 40. Preferably, the rigid serpentine pipe 53 and the cleaning nozzle 40 are manufactured from stainless steel alloys. Metallurgically brazing or soldering the serpentine pipe 53 and the cleaning nozzle 40 form an excellent thermal conduit. Since exterior flat surface 59 is in intimate thermal contact with the high pressure rigid serpentine pipe 53, the feed liquid is substantially cryogenically cooled, thus allowing the conversion of a significant fraction of the liquid CO2 stream to a solid crystalline snow phase. As mentioned above, crystalline snow is also somewhat hard and cold, and will contribute to further effective cleaning upon impact.

The preceding description has been presented only to illustrate and describe the invention. It is not intended to be exhaustive or to limit the invention to any precise form disclosed. Many modifications and variations are possible in light of the above teaching.

The preferred embodiments were chosen and described in order to best explain the principles of the invention and its practical application. The preceding description is intended to enable others skilled in the art to best utilize the invention in various embodiments and with various modifications as are suited to the particular use contemplated. It is intended that the scope of the invention be defined by the following claims.

What is claimed is:

1. A non-cryogenic cleaning system, comprising:

a pumping system receptive of a non-cryogenic liquid supply; the pumping system comprising:

a non-cryogenic receiving hose;

an intensifier capable of pressurizing non-cryogenic fluids to at least 35,000 PSI;

a first heat exchanger in fluid communication with the non-cryogenic receiving hose upstream of the intensifier;

a flexible umbilical capable of transporting non-cryogenic fluids at at least 35,000 PSI for insertion into a cleaning area downstream of the intensifier.

2. A non-cryogenic cleaning system according to claim 1, further comprising:

an air hose receptive of a pressurized air source;

a second heat exchanger in fluid communication with the air hose;

at least one abrasive particle hopper connected to the air hose;

wherein the air hose comprises a line of the flexible umbilical downstream of the at least one abrasive particle hopper.

3. A non-cryogenic cleaning system according to claim 2, wherein the at least one abrasive particle hopper comprises a garnet particle hopper and a $CO_2$ pellet hopper.

4. A non-cryogenic cleaning system according to claim 1, further comprising a third heat exchanger downstream of the intensifier.

5. A non-cryogenic cleaning system according to claim 1, further comprising a nozzle connected to the umbilical and a fourth heat exchanger at the nozzle.

6. A non-cryogenic cleaning system according to claim 1, wherein the intensifier comprises a hydraulic differential area piston pump.

7. A non-cryogenic cleaning system according to claim 6, further comprising a liquid cooled jacket surrounding the piston pump.

8. A non-cryogenic cleaning system according to claim 1, further comprising a portable trailer housing the pumping system.

9. A non-cryogenic cleaning system according to claim 1, further comprising a non-cryogenic fluid tank and an air compressor connected to the pumping system.

10. A non-cryogenic cleaning system according to claim 9, further comprising liquid non-cryogenic fluid in the flexible umbilical at at least 35,000 PSI and at a temperature of at least 20 degrees F.

11. A non-cryogenic cleaning system according to claim 1, further comprising a robotic arm connected to the flexible umbilical capable of directing a portion of the umbilical adjacent to a cleaning surface.

* * * * *